United States Patent [19]

Redmore et al.

[11] 4,146,556

[45] Mar. 27, 1979

[54] QUATERNARIES OF HYDROXYALKYLAMINOALKYLAMIDES

[75] Inventors: Derek Redmore, Ballwin; Benjamin T. Outlaw, Webster Groves, both of Mo.

[73] Assignee: Petrolite Corporation, St. Louis, Mo.

[21] Appl. No.: 814,571

[22] Filed: Jul. 11, 1977

Related U.S. Application Data

[62] Division of Ser. No. 684,711, May 10, 1976, Pat. No. 4,060,553.

[51] Int. Cl.[2] ..... C07C 103/183

[52] U.S. Cl. ..... 260/558 A; 260/558 R; 260/561 A

[58] Field of Search ..... 260/558 R, 559 A, 561 A

[56] References Cited

U.S. PATENT DOCUMENTS

| | | | |
|---|---|---|---|
| 2,328,021 | 8/1943 | Katzman et al. | 260/561 A |
| 3,714,249 | 1/1973 | Norton | 260/558 R |

*Primary Examiner*—Allen B. Curtis

*Attorney, Agent, or Firm*—Sidney B. Ring; Hyman F. Glass

[57] ABSTRACT

This invention relates to hydroxyalkylaminoalkylamides, the N-alkylated derivatives thereof, and the preparaton and uses thereof. This invention also relates to quaternaries of the abovementioned hydroxyalkylaminoalkylamides.

9 Claims, No Drawings

QUATERNARIES OF HYDROXYALKYLAMINOALKYLAMIDES

This application is a division of application Ser. No. 684,711 filed May 10, 1976, now U.S. Pat. No. 4,060,553, issued Nov. 29, 1977.

In U.S. Pat. No. 3,714,249 there is disclosed and claimed hydroxyalkylaminoalkylamides as illustrated by the formula

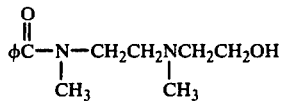

which is prepared from benzonitrile and N-methyl aminoethanol by the process of claim 3 of U.S. Pat. No. 3,714,249 which is as follows:

"3. A process for preparing a hydroxyalkylaminoalkylamide by reacting under anhydrous conditions in the absence of a catalyst, (a) a nitrile of structure $R_1(CN)_n$ where $R_1$ is selected from the group of alkyl of 1 to 10 carbon atoms, alkylene of two to 10 carbon atoms, phenyl, naphthyl, phenylene lower alkyl substituted phenyl of from seven to 12 carbon atoms, phenylalkyl of seven to 12 carbon atoms, and lower alkyl substituted phenylene of from seven to 12 carbon atoms, and n is a small integer of from one to three, with (b) an alkanolamine of structure

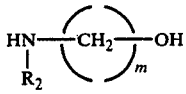

where $R_2$ is H or lower alkyl and m is an integer of 2 to 4, said reaction being conducted at a temperature of from about 100° to about 220° C., at essentially atmospheric pressure, and at a mole ratio of alkanolamine per nitrile group exceeding 2 to 1, but less than about 20:1."

The present process relates to such products, said products alkylated; and uses thereof particularly as corrosion inhibitors.

Two moles of alkanolamine will react with a nitrile to form novel linear hydroxyalkylaminoalkylamides having the structure

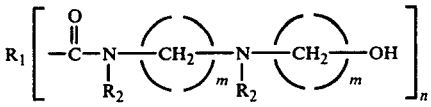

where $R_1$ is an alkyl, alkylene, aryl, aralkyl, or a lower alkyl substituted aryl group, $R_2$ is H or lower alkyl, m is an integer of from 2 to 4 and n is a small integer of from about 1 to about 6, preferably 1 to 3. In accord with the process of the invention these compounds are made by reacting under anhydrous conditions in the absence of a catalyst, a nitrile of structure

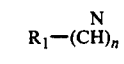

with an alkanolamine of structure

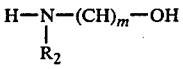

where $R_1$, $R_2$, m and n are above defined, said reaction being conducted at a temperature of from about 100° to about 220° C., at essentially atmospheric pressure and at a mole ratio of alkanolamine per nitrile group exceeding 2 to 1.

Examples of useful nitriles include alkyl nitriles such as acetonitrile, propionitrile, n-butyronitrile, isobutyronitrile, and the like; alkylene dinitriles such as malononitrile, succinonitrile, glutaronitrile, adiponitrile and the like, aromatic nitriles such as benzonitrile, toluonitrile, terephthalonitrile, isophthalonitrile, 1-cyanonaphthalene, 1,5-dicyanonaphthalene and the like. Aralkyl nitriles such as phenylacetonitrile, 1-naphthaleneacetonitrile, gamma-phenylbutryonitrile, and the like are also useful. Preferably, when $R_1$ is an alkyl or alkylene group it will contain from two to ten carbon atoms. When $R_1$ is an aryl, aralkyl, or lower alkyl substituted aryl group it will contain, preferably, from seven carbon atoms (e.g., benzonitrile) to twelve carbon atoms (e.g., 1,5-dicyanononaphthalene). Preferred nitriles are the mono and dinitriles of the benzene series.

Useful alkanolamines include hydroxyethylamine (ethanolamine), 2-amino-1-propanol, hydroxybutylamine, 3-hydroxypropylamine, N-methylethanolamine, N-ethylethanol-amine, and the like. The $R_2$ substituent on the alkanolamine will usually be an alkyl group having no more than about six carbon atoms.

In carrying out the reaction of the invention, the nitrile and alkanolamine are simply mixed and heated to reaction temperature, i.e., from about 100° to about 220° C., and when reaction temperature for the particular combination of reactants is reached, ammonia is evolved. The reaction is conducted at atmospheric pressure, under anhydrous conditions and in the absence of any catalyst. While it is possible to carry out the reaction in certain solvent systems, solvents are not necessary. However, certain polar solvents such as dioxane, pyridine, the dimethylether of ethylene glycol and the like are very useful in that they permit reaction to occur at reflux and also permit easy solvent removal from the product by distillation. Other solvents such as dimethylsulfoxide, dimethylformamide, dimethylacetamide, and the like are also operable, but may be troublesome in hampering product recovery. Non-polar solvents such as aromatic hydrocarbons and high boiling aliphatic compounds are not useful as a reaction medium.

It has been observed that if anhydrous conditions are not maintained, the reaction product contains only one alkanolamine moiety per cyano group instead of two. As indicated, the process requires that the mole ratio of alkanolamine to nitrile function exceed 2 to 1 and preferably will be between about 5:1 to 10:1. For practical purposes this ratio will not normally exceed about 20:1.

Completion of reaction is readily determined by cessation of ammonia evolution (one mole of ammonia is evolved for each cyano group). The reaction mass is worked up by any conventional procedure to recover the product. This is conveniently done by first vacuum distilling off excess alkanolamine and recovering the residue product by standard crystallization procedures. Conventional separation procedures are also useful where the linear hydroxyalkylaminoalkylamide product is mixed with any by-products of the reaction.

The hydroxyalkylaminoalkylamide products are white or wax-like solids having sharp melting points. They are generally insoluble in the usual organic solvents at room temperature, but have sufficient solubility at elevated temperatures to make them responsive to purification procedures by crystallization. Water solubility of the compounds is essentially complete at all proportions and such aqueous solutions show strong surfactant properties.

Examples of typical compounds of the invention include the mono- and bis-amide compounds such as 2-hydroxy-ethylaminoethylbenzamide of structure $$C_6H_5CONHCH_2CH_2NHCH_2CH_2OH,$$

2-hydroxyethylaminoethyltoluamide, 2-hydroxypropylaminopropylbenzamide, bis(2-hydroxyethylaminoethyl) terephthalamide of structure $$C_6H_4(CONHC_2H_4\overset{H}{N}C_2H_4OH)_2,$$

2-hydroxyethylaminoethylacetamide, 2-hydroxyhexylaminohexylbutyramide, and the like.

In the present invention, the reaction of U.S. Pat. No. 3,714,249 has been extended to include the reaction product of unsaturated nitriles with N-alkylalkanolamines to form similar compounds where in addition the N-alkylalkanolamine also reacts with the double bond of the unsaturated nitrile to form an N,N'-di(alkylalkanol). This is illustrated by the following equation:

$$CH_2{=}CHCN + 3\underset{\underset{R_2}{|}}{NH}{-}CH_2CH_2OH \longrightarrow$$

$$HOCH_2CH_2\underset{\underset{R_2}{|}}{N}CH_2CH_2\overset{\overset{O}{\|}}{C}\underset{\underset{R_2}{|}}{N}CH_2CH_2\underset{\underset{R_2}{|}}{N}CH_2CH_2OH + NH_3,$$

This product can then be mono- or dialkylated.

Thus, instead of a reaction with 2 moles of N-alkylethanolamine with 1 mole of nitrile, acrylonitrile reacts with 3 moles of N-alkylethanolamine.

In addition to acrylonitrile, the following types of unsaturated nitriles can also be employed in the reaction $$R'CH{=}\underset{\underset{R_2}{|}}{C}{-}CN$$

e.g., for example those of the general formula $$R'CH{=}\underset{\underset{R''}{|}}{C}{-}CN$$

where R' and R'' are hydrogen or a substituted group for example alkyl, aryl, cycloalkyl, alkaryl, aralkyl, etc. Typical examples include $$CH_2{=}\underset{\underset{R}{|}}{C}{-}CN$$

where R is alkyl, preferably methyl, such as methacrylonitrile $$\phi CH = CH\ CN$$

where $\phi$ is an aryl group preferably phenyl such as cinnamonitrile.

In addition, we have also discovered that the $R_2$ group of the alkanolamine can be a substituted alkyl group. For example, $R_2$ may be another alkanol group such as dialkanolamines, such as diethanolamines $HN(CH_2CH_2OH)_2$.

The N-substituted group employed in forming the quaternaries of this invention include not only alkyl groups but also cycloalkyl, aryl, aralkyl, oxyalkyl, alkenyl, etc. The substituted group may contain about 1-30 or more carbons, such as from about 1 to 24 carbons, for example from about 1 to 18 carbons, but preferably from about 1 to 12 carbons.

In the preferred embodiment, at least one group containing at least about 6 or more carbons is employed such as from about 8 to 12 carbons.

The anion may be any suitable group such as halide, sulfate, carboxylates, etc., but is preferably chloride.

In general, the amines are alkylated by the following procedure.

The aminoamide is dissolved in a solvent and heated at 60°-180° for 2-24 hrs. Suitable solvents include alcohols, methanol ethanol, n-propanol, isopropanol, butanol, etc., water, dimethyl formamide, dimethylsulfoxide, etc. Alternatively, the aminoamides can be alkylated without solvents simply by heating the aminoamide and alkylating reagent at 50°-140° for example. All temperatures are stated in ° C.

The nitrile/alkanolamine reaction is illustrated as follows:

$$R_1CN + 2\underset{\underset{R_2}{|}}{HN}CH_2CH_2OH \longrightarrow$$

$$R_1\overset{\overset{O}{\|}}{C}\underset{\underset{R_2}{|}}{N}CH_2CH_2\underset{\underset{R_2}{|}}{N}CH_2CH_2OH + NH_3$$

The alkylation is illustrated as follows:

$$R_1\overset{\overset{O}{\|}}{C}\underset{\underset{R_2}{|}}{N}CH_2CH_2\underset{\underset{R_2}{|}}{N}CH_2CH_2OH + R_3X \longrightarrow$$

$$R_1\overset{\overset{O}{\|}}{C}\underset{\underset{R_2}{|}}{N}{-}CH_2CH_2\overset{\overset{R_3}{|}}{\overset{\oplus}{N}}\underset{\underset{R_2}{|}}{N}CH_2CH_2OH \quad X^{\ominus}$$

We have extended the reaction to acrylonitrile where the reaction proceeds as follows:

$$CH_2{=}CHCN + 3\underset{\underset{R_2}{|}}{NH}{-}CH_2CH_2OH \longrightarrow$$

-continued

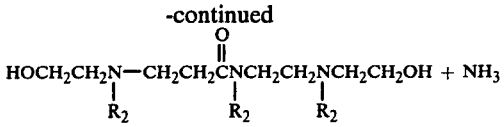

This can then be mono- or dialkylated.

The following examples are presented to illustrate the preparation of the hydroxyalkylaminoalkylamides.

EXAMPLE 1

Benzonitrile (58.7g, 0.57 mole) and 2-(methyl amino)-ethanol (129g, 1.72 mole) were stirred at 150°-180° (reflux) for 30½ hrs. under a continuous sweep of Nitrogen. Evolution of $NH_3$ was evident during the reaction. The resulting mixture was distilled under vacuum to remove the excess amine. The viscous reaction product (115.4g) was found to have the structure

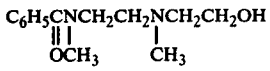

which in hydrolysis yields benzoic acid and the amine,

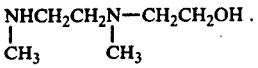

EXAMPLE 2

Benzonitrile (34.3g, 0.33 mole) and diethanolamine (105.1g, 1 mole) were stirred at 150°-180° for 26 hrs. Anhydrous conditions were maintained by a continuous nitrogen sweep. Strong evolution of $NH_3$ was evident during the course of the reaction. The resulting mixture was distilled under vacuum to remove excess amine yielding 84.2g of viscous oil. The structure of the product is:

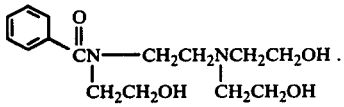

EXAMPLE 3

Benzonitrile (103g, 1 mole) and monoethanolamine (183.3g, 3 mole, $R_2$=H) were stirred at 150°-180° for 27 hrs. under anhydrous conditions (via $N_2$ sweep) with rapid evolution of $NH_3$. The excess monoethanolamine was removed by vacuum distillation to yield 195.1g of viscous oil. The product is largely:

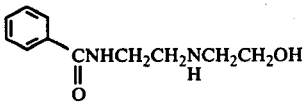

EXAMPLE 4

Acrylonitrile (35.3g, 0.67 mole) was added slowly (15 min) to 2-(methylamino)-ethanol (150.2g, 2 mole). The exothermic reaction was maintained at 50° by a water bath. After stirring at room temp. for 30 min. the mixture was heated at 150°-180° for 47 hrs. Distillation under vacuum yielded only 5g of excess amine leaving 112.5g of viscous product.

The product was shown to be

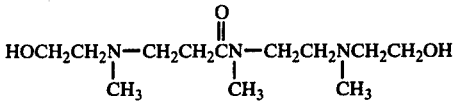

by hydrolysis with 10% sodium hydroxide solution which yielded

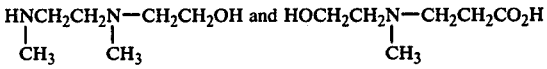

EXAMPLE 5

Acrylonitrile (16.8g, 0.32 mole) was added to diethanolamine (100g, 0.95 mole) with an exothermic reaction occurring that was controlled at 50° by water bath cooling. After stirring the resulting mixture for 15 min. at room temperature it was heated at 150°-180° for 25 hrs. Vacuum distillation of the reaction product gave only 6g of excess amine and 82.9g of a viscous oil.

The structure was shown to be

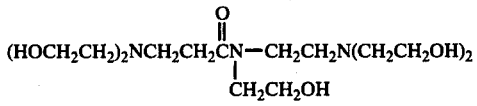

by hydrolysis

EXAMPLE 6

Acrylonitrile (43.5g, 0.82 mole) was added to monoethanolamine (150g, 2.45 mole) with water bath cooling to control the exothermic reaction. After stirring the resulting mixture at room temperature for 30 min. it was heated at 150°-180° for 9 hrs. to yield 51.8g of viscous oil after removal of slight excess of amine.

The product is mainly

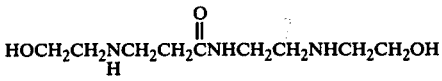

The following examples are presented to illustrate the preparation of alkylated derivatives.

EXAMPLE 7

Benzyl chloride (38g, 0.3 mole) was added at 100° to the amide (62.8g, 0.3 mole) of Example 1 during 20 mins. The mixture was stirred at 100° for 6 hrs. to yield the expected benzyl derivative 99.8g.

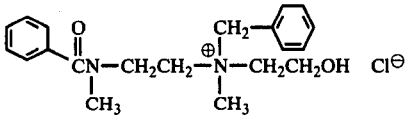

The following table summarizes additional alkylated derivatives prepared in the manner of Example 7.

| Example No. | Amino amide | Alkylating reagent |
|---|---|---|
| 8 | Ex. 2 | $PhCH_2Cl$ |

-continued

| Example No. | Amino amide | Alkylating reagent |
|---|---|---|
| 9 | Ex. 3 | $PhCH_2Cl$ |
| 10 | Ex. 4 | $PhCH_2Cl$ |
| 11 | Ex. 5 | $PhCH_2Cl$ |
| 12 | Ex. 6 | $PhCH_2Cl$ |

USE IN BRINES

This phase of the invention relates to the prevention of corrosion in systems containing a corrosive aqueous medium, and most particularly in systems containing brines.

More particularly, this invention relates to the prevention of corrosion in the secondary recovery of petroleum by water flooding and in the disposal of waste water and brine from oil and gas wells. Still more particularly, this invention relates to a process of preventing corrosion in water flooding and in the disposal of waste water and brine from oil and gas wells which is characterized by injecting into an underground formation an aqueous solution containing minor amounts of compositions of this invention, in sufficient amounts to prevent the corrosion of metals employed in such operation. This invention also relates to corrosion inhibited brine solutions of these compounds.

When an oil well ceases to flow by the natural pressure in the formation and/or substantial quantities of oil can no longer be obtained by the usual pumping methods, various processes are sometimes used for the treatment of the oil-bearing formation in order to increase the flow of the oil. These processes are usually described as secondary recovery processes. One such process which is used quite frequently is the water flooding process wherein water is pumped under pressure into what is called an "injection well" and oil, along with quantities of water, that have been displaced from the formation, are pumped out of an adjacent well usually referred to as a "producing well." The oil which is pumped from the producing well is then separated from the water that has been pumped from the producing well and the water is pumped to a storage reservoir from which it can again be pumped into the injection well. Supplementary water from other sources may also be used in conjunction with the produced water. When the storage reservoir is open to the atmosphere and the oil is subject to aeration this type of water flooding system is referred to herein as an "open water flooding system."

Because of the corrosive nature of oil field brines, to economically produce oil by water flooding, it is necessary to prevent or reduce corrosion since corrosion increases the cost thereof by making it necessary to repair and replace such equipment at frequent intervals.

We have now discovered a method of preventing corrosion in systems containing a corrosive aqueous media, and most particularly in systems containing brines, which is characterized by employing the compositions of this invention.

We have also discovered an improved process of protecting from corrosion metallic equipment employed in secondary oil recovery by water flooding such as injection wells, transmission lines, filters, meters, storage tanks, and other metallic implements employed therein and particularly those containing iron, steel, and ferrous alloys, such process being characterized by employing in water flood operation the compositions of this invention.

This phase of the invention then is particularly concerned with preventing corrosion in a water flooding process characterized by the flooding medium containing an aqueous or an oil field brine solution of these compounds.

In many oil fields large volumes of water are produced and must be disposed of where water flooding operations are not in use or where water flooding operations cannot handle the amount of produced water. Most states have laws restricting pollution of streams and land with produced waters, and oil producers must then find some method of disposing of the waste produced salt water. In many instances, therefore, the salt water is disposed of by injecting the water into permeable low pressure strata below the fresh water level. The formation into which the water is injected is not the oil producing formation and this type of disposal is defined as salt water disposal or waste water disposal. The problems of corrosion of equipment are analagous to those encountered in the secondary recovery operation by water flooding.

The compositions of this invention can also be used in such water disposal wells thus providing a simple and economical method of solving the corrosion problems encountered in disposing of unwanted water.

Water flood and waste disposal operations are too well known to require further elaboration. In essence, in the present process, the flooding operation is effected in the conventional manner except that the flooding medium contains a minor amount of the compound of this invention, sufficient to prevent corrosion, in concentrations of about 10 p.p.m. to 10,000 p.p.m., or more, for example, about 50 to 5,000 p.p.m., but preferably about 15 to 1,500 p.p.m. The upper limiting amount of the compounds is determined by economic considerations. Since the success of a water flooding operation manifestly depends upon its total cost being less than the value of the additional oil recovered from the oil reservoir, it is quite important to use as little as possible of these compounds consistent with optimum corrosion inhibition. Optimum performance is generally obtained employing about 5–100 p.p.m. Since these compounds are themselves inexpensive and are used in low concentrations, they enhance the success of a flood operation by lowering the cost thereof.

While the flooding medium employed in accordance with the present invention contains water or oil field brine and the compounds, the medium may also contain other materials. For example, the flooding medium may also contain other agents such as surface active agents or detergents which aid in wetting throughout the system and also promote the desorption of residual oil from the formation, sequestering agents which prevent the deposition of calcium and/or magnesium compounds in the interstices of the formation, bactericides which prevent the formation from becoming plugged through bacterial growth, tracers, etc. Similarly, they may be employed in conjunction with any of the operating techniques commonly employed in water flooding and water disposal processes, for example five spot flooding, peripheral flooding, etc., and in conjunction with other secondary recovery methods.

The following examples illustrate the use of the compositions of this invention as corrosion inhibitors.

| Conditions: | 2% NaCl Solution<br>Atm. Pressure<br>Room Temperature<br>Constant $CO_2$ Aparge (Coleman Instrument Grade)<br>Constant Stirring<br>500 p.p.m. of inhibitor based on active component |
|---|---|

| | Corrosion Rate (mpy) | | | |
|---|---|---|---|---|
| Example | 1 hr. | (Protection) | 24 hr. | (Protection) |
| 2 | 26 | (81%) | 6.8 | (96%) |
| 5 | 20 | (86%) | 16 | (90%) |
| 7 | 35 | (75%) | 41 | (76%) |
| 8 | 10 | (93%) | 2.4 | (99%) |
| 9 | 5.4 | (96%) | 3.4 | (98%) |
| 11 | 54 | (61%) | 38 | (77%) |
| 12 | 56 | (60%) | 28 | (83%) |
| Blank | 140 | | 168 | |

We claim:

1. Quaternaries of products produced by reacting about 1 mole of an unsaturated nitrile with about 3 moles of an alkanolamine so that one mole reacts with the unsaturated group to form an N-alkanol group and the other 2 moles react with the nitrile group to form an hydroxyalkylaminoalkylamide group.

2. Quaternaries of products of claim 1 where the unsaturated nitrile is an acrylo- or a substituted acrylonitrile.

3. Quaternaries of products of claim 2 where the unsaturated nitrile is acrylonitrile.

4. Quaternaries of products of claim 1 where the unsaturated nitrile is an arylnitrile.

5. Quaternaries of products of claim 4 where the arylnitrile is $\phi CH{=}CH\text{-}CN$.

6. The quaternaries of claim 2 wherein R′ is aryl, R″ is hydrogen and $R_2$ is methyl.

7. The quaternaries of claim 2 of the formula

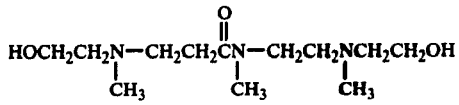

8. The quaternaries of claim 2 of the formula

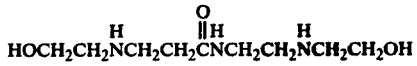

9. Quaternaries of compounds of the formula

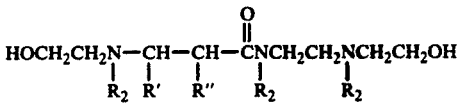

where R′ and R″ are hydrogen, alkyl, aryl, cycloalkyl, alkaryl or aralkyl and $R_2$ is hydrogen, alkyl, cycloalkyl, aryl, aralkyl, hydroxyalkyl or alkenyl.

* * * * *